United States Patent [19]

Ivester et al.

[11] Patent Number: 4,502,872

[45] Date of Patent: Mar. 5, 1985

[54] DISCHARGE ELECTRODE WIRE ASSEMBLY FOR ELECTROSTATIC PRECIPITATOR

[75] Inventors: Frank D. Ivester, Alabaster; James R. Troulias, Birmingham, both of Ala.

[73] Assignee: Combustion Engineering, Inc., Windsor, Conn.

[21] Appl. No.: 480,971

[22] Filed: Mar. 31, 1983

[51] Int. Cl.[3] ..... B03C 3/08; B03C 3/40

[52] U.S. Cl. ..... 55/147; 55/148

[58] Field of Search ..... 55/140, 147, 148

[56] References Cited

U.S. PATENT DOCUMENTS 1,843,510 2/1932 Hale ..... 55/147

3,109,720 11/1963 Cummings et al. ..... 55/13

3,703,799 11/1972 Humphreys ..... 55/148

*Primary Examiner*—David L. Lacey

*Attorney, Agent, or Firm*—William W. Habelt

[57] ABSTRACT

An electrostatic precipitator (10) having a casing (12) defining a precipitation chamber (6) wherein a plurality of discharge electrode frames (32) are disposed alternately between a plurality of collecting electrode plates (20). Each discharge electrode frame is comprised of a plurality of individual discharge electrode wires (36) tautly strung across a support frame. Individual discharge electrode wires are maintained in a taut condition during operation by tensioning coil springs (50) which interconnect neighboring discharge electrode wires to take-up any lengthening of the discharge electrode wires in a horizontal direction.

5 Claims, 2 Drawing Figures

DISCHARGE ELECTRODE WIRE ASSEMBLY FOR ELECTROSTATIC PRECIPITATOR

BACKGROUND OF THE INVENTION

The present invention relates to electrostatic precipitators and, more particularly, to an apparatus for tensioning the discharge electrode wires of a rigid-frame type electrostatic precipitator. In the operation of an electrostatic precipitator, a gas laden with entrained particulate material is passed through an electrostatic field established about a discharge electrode disposed between two grounded collecting electrodes. The suspended particles become electrically charged as they pass through the electrostatic field and move to, under the influence of the electrostatic field, and deposit upon the grounded collecting electrodes flanking the discharge electrode.

Typically, each collecting electrode is formed of one or more elongated plates disposed in a row side by side and suspended from the top of the precipitator housing in a vertical plane. A plurality of such collecting electrodes are disposed transversely across the precipitator casing in spaced vertical planes parallel to the direction of the gas flow through the precipitator.

In what is commonly referred to as a rigid-frame electrostatic precipitator, a box-like framework comprised of a plurality of discharge electrode frames is suspended from insulators at the top of the precipitator housing to provide a row of vertically disposed discharge electrodes between adjacent collecting electrodes across the width of the precipitator. A voltage is applied to the discharge electrodes to generate the electrostatic field.

Each discharge electrode frame is comprised of a plurality of individual discharge electrode wires tautly strung across a support frame. As the electrode wires are installed at ambient temperature but typically operated at temperatures in the range of 150C to 250C, the discharge electrode wires may elongate due to thermal expansion and therefore become loose. Discharge electrode wires may also become loose due to handling during erection and shipment of the rigid discharge electrode frames.

Although a loose wire will not impede the dust collection process per se, a loose discharge electrode wire will not respond well in the rapping process. It is typical to periodically rap the discharge electrode frame to vibrate off any dust collecting on the discharge electrode wires as the collection of dust thereon can result in severe arcing between the discharge electrode wire and its neighboring collecting electrodes or in the shorting of electrostatic field by bridging of dust deposits between the discharge electrode wire and its neighboring collecting electrodes. A loose discharge electrode wire, however, will not vibrate as well as, and therefore not clean as easily as, a properly taut discharge electrode wire.

The typical prior art solution to the problem of loose discharge electrode wires is to shut the electrostatic precipitator down and re-tension the wires manually, one at a time, by re-welding or twisting the discharge electrode wires to take up the looseness. Of course, this is a time-consuming, labor intensive task. Additionally, in severe cases of loss of tension in the discharge electrode wires, it may be necessary to replace the entire discharge electrode frame in which the loose wires are located.

SUMMARY OF THE INVENTION

It is therefore an object of the present invention to provide an apparatus for tensioning the discharge electrode wires of an electrostatic precipitator in order to maintain the discharge electrode wire sufficiently taut so as to facilitate the cleaning process of the discharge electrode wire.

Accordingly, there is provided an electrostatic precipitator comprising a casing for conveying a flow of gas to be cleaned, a collecting electrode assembly of a plurality of collecting electrode plates disposed parallel to the gas flow through the casing and arranged in spaced planes, a discharge electrode assembly of a plurality of discharge electrode frames disposed parallel to and alternately between the collecting electrode plates, a plurality of discharge electrode wires strung at spaced intervals within each of the discharge electrode frames, and tensioning spring means operatively associated with the discharge electrode wires for maintaining the discharge electrode wires in a taut condition.

In accordance with the preferred embodiment of the present invention, the tensioning spring means comprises one or more coil springs disposed perpendicularly to extend between a pair of neighboring discharge electrode wires. The coil springs serve to take up the looseness in the discharge electrode wires in a direction perpendicular to the electrode wires. Additionally, the coil springs would only affect the loose discharge wires as the springs would be chosen to have a spring constant sufficient to take up the looseness, i.e., elongation, of any loose discharge electrode wires but not overly strong so as to distort or snap properly tensioned discharge electrode wires.

BRIEF DESCRIPTION OF THE DRAWINGS

The present invention would be better understood and the above and other objects of the present invention will become more apparent and appreciated when viewed in light of the following description of a preferred embodiment with reference to the accompanying drawings wherein.

DESCRIPTION OF THE PREFERRED EMBODIMENT

Figure 1:
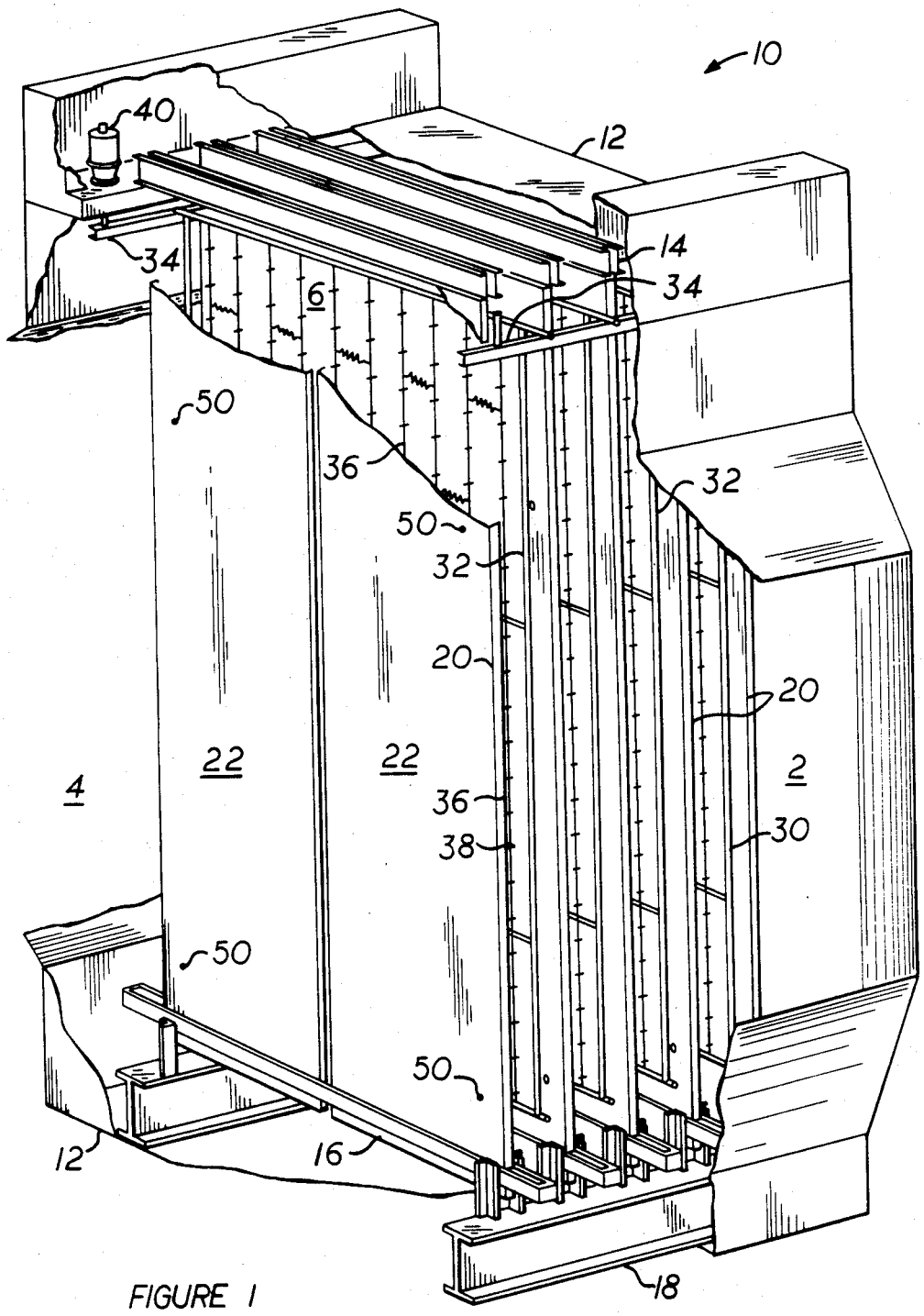
FIG. 1 is a perspective view, partly in section of an improved electrostatic precipitator incorporating the present invention.

Referring now to the drawing, and most particularly to FIG. 1 thereof, there is depicted therein an electrostatic precipitator 10 having a casing 12 with an inlet 2, an outlet 4 and a precipitation chamber 6 disposed therebetween. The particulate laden flue gas to be cleaned passes through the housing 12 of the precipitator 10 passing from the gas inlet 2 through the precipitation chamber 6 and out the gas outlet 4 as a clean, relatively particulate free gas.

The basic configuration of the precipitator 10 shown in FIG. 1 is well known in the prior art, and is typically referred to as a rigid frame-type electrostatic precipitator. A plurality of substantially rectangular collecting electrode plates 22, forming collectively a collecting electrode plate assembly 20, are disposed in substantially parallel, spaced relationship in vertical planes within the precipitation chamber 6. Interdisposed in the spaces between the collecting electrode plates 22 are a plurality of discharge electrode frames 32 which collectively form a discharge electrode assembly 30. Both the collecting electrode plates 22 and the discharge electrode frames 32 are aligned parallel to and extend in the direction of gas flow through the precipitation chamber 6 from the inlet 2 to the outlet 4 thereof.

Each collecting electrode plate 22 is suspended and supported from upper support beams 14 disposed across the top of the precipitation chamber 6. The lower end of each of the suspended collecting electrode plates 22 is laterally constrained from movement by inserting it into a guide member 16 which is mounted to the lower support beams 18 disposed in the bottom of the precipitation chamber 6. Thus, the suspended electrode plates, which may range anywhere from 12 to 50 feet in height, are free to move vertically downward within the guide members 16 due to temperature effects but are constrained from any lateral movement by guide members 16.

The collecting electrode plates 22 are shown in the drawing as being of a particular cross section merely for purposes of illustration and not limitation. It is to be understood that the present invention contemplates utilizing collecting electrode plates of any of a number of cross-sectional designs with the particular design utilized in any given situation being selected on an individual basis to give optimal precipitation efficiency and a quiescent zone at the surface of the collecting electrode plates 22.

Figure 2:
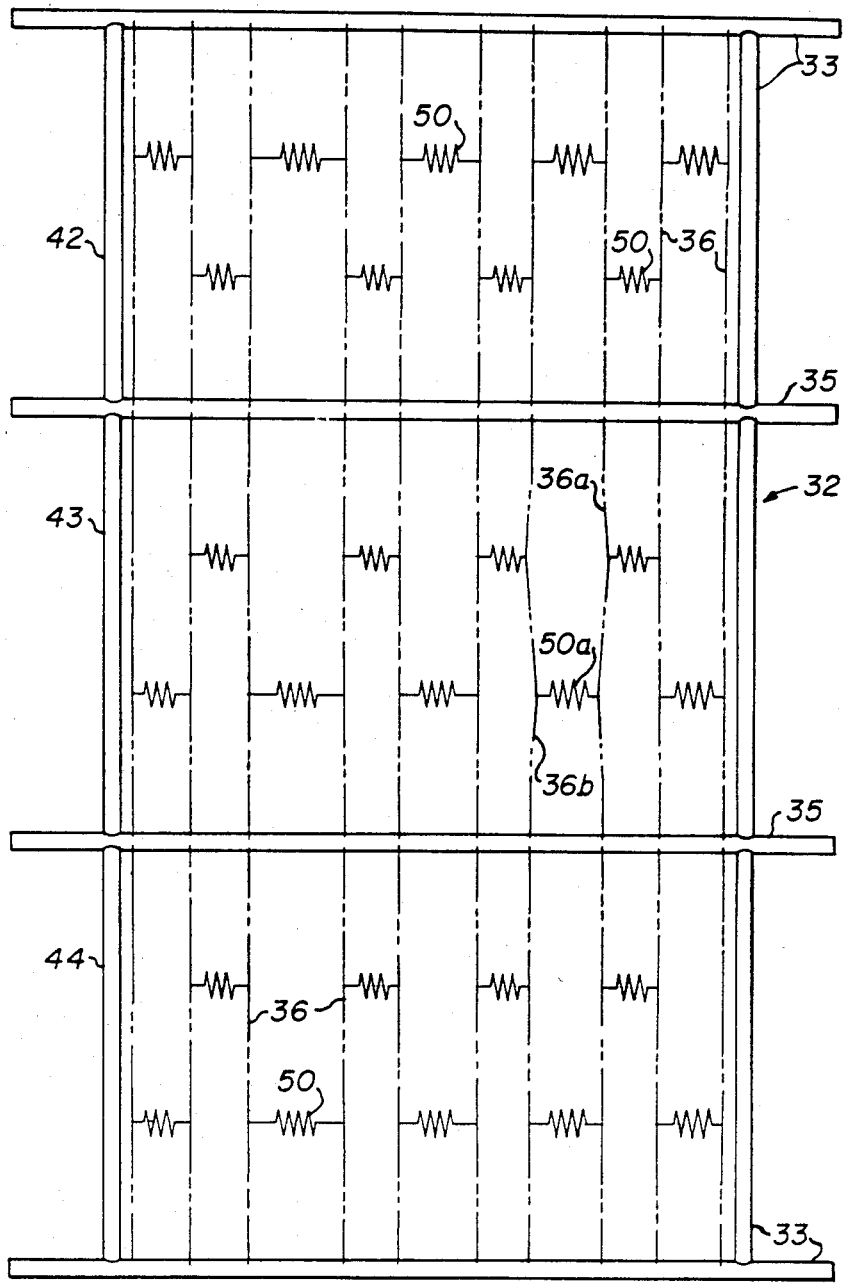
FIG. 2 is a side elevational view, showing a single discharge electrode frame equipped with a plurality of tensioning spring means as taught by the present invention.

The individual discharge electrode wire assemblies 32 collectively, and in conjunction with a support bar 34 from which the individual electrode wire assemblies 32 are supported and suspended, form a box-like discharge electrode frame assembly 30. As best seen in FIG. 2, each of the individual discharge electrode wire assemblies 32 is formed of a pair of vertical and a pair of horizontal tubular support members 33 welded together to form a rectangular frame. Preferably, intermediate cross members 35 are welded between vertical support members 33 so as to divide a discharge electrode frame into upper, middle and lower sections 42, 43 and 44 respectively. This arrangement provides for a strong, rigid support frame which is suspended from and supported by support beams 34 disposed at the top of the precipitation chamber 6 and mounted to the casing 12 through insulators 40.

Mounted within each section of the discharge electrode frames 32 are a plurality of vertically strung discharge electrode wires 36 disposed at spaced intervals along the direction of gas flow so as to provide an electrostatic field along the length at a precipitation chamber 6. Although any number of discharge electrode wire designs may be utilized, the typical electrode comprises a flat, thin, rectangular in cross-section strip-like element or a round wire-like element having a plurality of corona discharge points 38 disposed at spaced intervals along its length.

In operation, a particular laden gas enters the precipitator casing 12 through the inlet 2 thereof and flows through the precipitation chamber 6 to the outlet 4. In traversing the precipitation chamber 6, the particulate laden gas flows between the space collecting electrodes 20 and the discharge electrode wires 36 disposed therebetween. Due to the action of the corona formed about the corona discharge points 38 on the discharge electrode wires 36 and the electrostatic field extending between the discharge electrode wires and the collecting plates, the particulates within the gas are ionized and migrate to and deposit upon the collecting electrode plates 22. However, some dust particles will, rather than migrating to the collecting electrode plates 22, deposit on the discharge electrode wires 36. Therefore, it is necessary to occasionally clean the discharge electrode wires 36 by vibrating the discharge electrode frames 32 typically by means of a rapping mechanism, not shown.

As mentioned previously, it is desirable that the discharge electrode wires 36 be in a taut condition so that when rapped they will vibrate and thereby shake off any dust particles collecting thereon. However, during the normal course of operations, discharge electrode wires occasionally become loose due to the effects of gas flow and temperature. Therefore, in accordance with the present invention, there is provided tensioning spring means operatively associated with the discharge electrode wire 36 for adjustably maintaining the tension thereon.

As best seen in FIG. 2, the tensioning spring means of the present invention comprises spring means, such as coil springs 50, disposed transversely between and perpendicular to neighboring discharge electrode wires **36*a* and 36*b*. One end of the coil spring 50*a* is attached to wire 36*a* of the pair of neighboring discharge electrode wires and the other end of the coil spring 50*a* is attached to wire 36*b*** of the pair of neighboring discharge electrode wires.

If the wires **36*a* or 36*b* become loose, as may occur when the discharge electrode wire elongate during operation under the influence of temperature, a coil spring 50*a* would maintain the wire 36*a* and/or 36*b* in taut condition despite their elongation. The coil spring 50*a* would take up the vertical lengthening of the wires 36*a* and/or 36*b* in a horizontal direction thereby returning the wires to a taut condition as illustrated in FIG. 2**.

Preferably, a plurality of coil springs 50 are attached between neighboring pairs of discharge electrode wires 36 disposed in each of the sections 42, 43 and 44 of the discharge electrode frame 32, so that each wire is interconnected to at least one neighboring wire by means of a coil spring 50. More preferably, each of the discharge electrode wires is interconnected by a pair of coil springs 50 to each of its neighboring wires with the coil springs disposed at spaced apart locations along the length of the wires with one spring of the pair connected to the neighboring wire lying to the right and the other spring of the pair connected to the neighboring wire lying to the left.

It is preferred that the coil springs 50 be arranged in two rows per each of the sections 42, 43 and 44 of the discharge electrode frame 32 as shown in FIG. 2. Preferably, a first plurality of springs 50 is installed between alternate neighboring pairs of discharge electrode wires in a horizontal row at a location about one-third of the height of the section below the top of the section and a second plurality of springs 50 is installed between alternate neighboring pairs of discharge electrode wires in a horizontal row at a location about one-third of the height of the section above the bottom of the section, with the springs 50 of one row offset by one discharge electrode wire from the springs of the other row in the section.

In this manner, each discharge electrode wire 36, with the exception of the outermost wires at the sides of the frame 32, is attached to two coil springs, with one of the springs extending horizontally to the right to the neighboring discharge electrode wire lying to the right and with the other of the springs extending horizontally to the left to the neighboring discharge electrode wire lying to the left. Any loosening of the discharge electrode wires 36 in any section of the frame 32 would be taken up in a horizontal tension along two lines, one line a third of the length of the wire down from the top of the section and the other line a third of the length of the wire up from the section.

Although described and illustrated herein with reference to the preferred embodiment shown in the drawing and representing the best mode presently contemplated for carrying out the present invention, it is to be understood that many variations of the depicted embodiment may be envisioned by those skilled in the art without departing from the basic concept of the present invention. Accordingly, it is intended that the present invention be interpreted in spirit and in scope as defined by the claims appended hereto.

We claim:

1. An electrostatic precipitator comprising:

a. a casing having a gas inlet and a gas outlet for conveying a horizontal flow of gas to be cleaned;

b. a collecting electrode assembly disposed within the casing between the gas inlet and the gas outlet, said collecting electrode assembly comprised of a plurality of collecting electrode plates disposed parallel to the gas flow direction through the casing and arranged in spaced planes;

c. a discharge electrode assembly to which a voltage is applied to generate an electrostatic field comprised of a plurality of discharge electrode frames disposed parallel to and alternately intermediate between said collecting electrode plates and a plurality of discharge electrode wires tautly strung parallel to each other at spaced intervals within each of said discharge electrode frames; and d. tensioning means positioned and arranged with respect to said discharge electrode wires for maintaining the discharge electrode wires in a taut condition, said tensioning means constructed so as to take up any loosening of the discharge electrode wires in a direction perpendicular to the discharge electrode wires.

2. An electrostatic precipitator as recited in claim 1, wherein said tensioning means comprises a plurality of tensioning spring means disposed perpendicular to and interconnected between neighboring said discharge electrode wires, said tensioning spring means constructed so as to maintain the discharge electrode wires in a taut condition.

3. An electrostatic precipitator as recited in claim 2 wherein said tensioning spring means each comprises a coil spring.

4. A discharge electrode wire assembly for an electrostatic precipitator comprising:

a. a substantially rectangular support frame formed of a first pair of horizontally disposed, vertically spaced support members and a second pair of vertically disposed, horizontally spaced support members, said second pair of support members extending between and interconnected with said first pair of support members to form a continuous frame;

b. a plurality of discharge electrode wires tautly strung parallel to each other at spaced intervals within said support frame; and c. a plurality of tensioning spring means disposed perpendicular to and interconnected between neighboring discharge electrode wires, said tensioning spring means constructed so as to maintain the discharge electrode wires in a taut condition.

5. A discharge electrode wire assembly as recited in claim 4 wherein said tensioning spring means each comprise a coil spring.

* * * * *